US011998813B2

(12) United States Patent
Patton

(10) Patent No.: US 11,998,813 B2
(45) Date of Patent: Jun. 4, 2024

(54) ADJUSTABLE GOLF CLUB

(71) Applicant: Douglas Patton, Newport Beach, CA (US)

(72) Inventor: Douglas Patton, Newport Beach, CA (US)

( * ) Notice: Subject to any disclaimer, the term of this patent is extended or adjusted under 35 U.S.C. 154(b) by 621 days.

(21) Appl. No.: 17/240,647

(22) Filed: Apr. 26, 2021

(65) Prior Publication Data

US 2021/0252350 A1 Aug. 19, 2021

Related U.S. Application Data

(63) Continuation-in-part of application No. 15/903,914, filed on Feb. 23, 2018, now abandoned.

(60) Provisional application No. 62/462,607, filed on Feb. 23, 2017.

(51) Int. Cl.
*A63B 53/06* (2015.01)
*A63B 53/04* (2015.01)

(52) U.S. Cl.
CPC ..... *A63B 53/06* (2013.01); *A63B 53/0416* (2020.08); *A63B 2053/0491* (2013.01); *A63B 2209/08* (2013.01)

(58) Field of Classification Search
CPC ..... A63B 53/06; A63B 53/0416; A63B 2053/0491; A63B 2209/08; A63B 53/0487; A63B 53/065; A63B 53/08
See application file for complete search history.

(56) References Cited

U.S. PATENT DOCUMENTS

| | | | | |
|---|---|---|---|---|
| 4,884,808 | A * | 12/1989 | Retzer | A63B 53/04 473/342 |
| 6,015,354 | A * | 1/2000 | Ahn | A63B 53/04 473/341 |
| 6,080,070 | A * | 6/2000 | Whitley | A63B 60/52 473/328 |
| 7,588,499 | B2 * | 9/2009 | Tateno | A63B 60/02 473/340 |
| 8,382,604 | B2 * | 2/2013 | Billings | A63B 53/065 473/340 |
| 8,485,918 | B2 | 7/2013 | Roach et al. | |
| 8,556,745 | B2 * | 10/2013 | Currie | A63B 60/02 473/342 |
| 9,855,474 | B2 * | 1/2018 | Beno | A63B 53/0466 |
| 9,861,867 | B2 * | 1/2018 | Parsons | A63B 53/06 |
| 10,046,211 | B2 * | 8/2018 | Franklin | A63B 53/065 |
| 2004/0142762 | A1 * | 7/2004 | Bunker | A63B 69/3685 473/340 |
| 2009/0258725 | A1 * | 10/2009 | Jones | A63B 53/0487 473/341 |
| 2012/0258820 | A1 * | 10/2012 | Roach | A63B 60/54 473/332 |

(Continued)

FOREIGN PATENT DOCUMENTS

AU 2008276395 A1 * 1/2010 ..... A63B 53/007

*Primary Examiner* — Jeffrey S Vanderveen
(74) *Attorney, Agent, or Firm* — Ryan Dean; Umberg Zipser LLP

(57) ABSTRACT

Various embodiments of a golf club are described that has a removable face weight to dramatically alter the weight of the head of the golf club and change the dynamics of the golf club by simply changing the face weight. The golf club is also configured to receive one or more weights to allow the weight of the head to be varied and permit a change in the weight distribution of the head.

14 Claims, 18 Drawing Sheets

(56) References Cited

U.S. PATENT DOCUMENTS

| | | | | |
|---|---|---|---|---|
| 2014/0031142 | A1* | 1/2014 | Billings | A63B 53/0466<br>473/335 |
| 2018/0001157 | A1* | 1/2018 | Abe | A63B 53/047 |
| 2018/0005876 | A1* | 1/2018 | Tung | H01L 23/53295 |
| 2018/0008870 | A1* | 1/2018 | Cornelius | A63B 53/04 |
| 2018/0008871 | A1* | 1/2018 | Lafortune | A63B 60/42 |
| 2019/0015715 | A1* | 1/2019 | Parsons | A63B 53/04 |

* cited by examiner

ADJUSTABLE GOLF CLUB

This application is a continuation-in-part application of U.S. non-provisional application having Ser. No. 15/903,914 filed on Feb. 23, 2018, which itself claims priority to U.S. provisional application having Ser. No. 62/462,607, filed on Feb. 23, 2017. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is golf clubs.

BACKGROUND

The following description includes information that may be useful in understanding the present invention. It is not an admission that any of the information provided herein is prior art or relevant to the presently claimed invention, or that any publication specifically or implicitly referenced is prior art.

Various adjustable golf clubs are known in the art, such as described in U.S. Pat. Nos. 4,884,808; 7,588,499; 8,556,745; 9,855,474; 8,382,604; and others. However, all of those known to Applicant suffer from one or more disadvantages including, for example, the lack of a removable face weight that is inserted within the head and becomes flush with a face of the head's frame; the ability to quickly add or remove weights as desired without the need to disassemble all or a portion of the head.

Known golf clubs having adjustable weight generally utilize small weights that are attached via screws and inserted on the left or right side of the golf club and usually underneath. For example, U.S. Patent Publication no. 2009/0258725 illustrates a golf club where weights can be added to the left or right bottom portions of the clubs. Typically, such weights are very small relative (i.e., no more than 10% of the total weight of the club) to the overall weight of the golf club (e.g., putters weigh between 330 and 365 grams).

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for an adjustable golf club that overcomes these challenges.

SUMMARY OF THE INVENTION

The inventive subject matter provides apparatus, systems and methods of an adjustable golf club, having a body or head with a removable face weight that accounts for a significant portion of the golf club's weight when the face weight is coupled with the head. In some embodiments, the removable face weight may account for at least 20%, but in other embodiments could be 40% or more than half of the total weight of the head when the face weight is coupled to the head. In such embodiments, a majority of the weight of the head of the golf club is removable, which to the inventor's knowledge has never been done before. This novel approach allows a golf player significant control over the total weight and distribution of weight of the golf club, and adjusting the face weight changes the dynamic of the golf club in a manner never before achieved.

The head preferably comprises a hollow interior that is at least partially defined by first and second through holes that extend from the top surface to the bottom surface of the head to reduce the overall weight of the head when the face weight is uncoupled from the head.

Preferably, the first and second through holes are separated from one another by a dividing wall that forms a portion of a boundary of each of the first and second through holes. The side walls of the first and second through holes can be inwardly tapered such that each of the first and second through holes has a diameter that decreases from the top surface to a minimum distance at a middle portion of the head as measured between the top and bottom surfaces, and increases from the middle portion to the bottom surface. Thus, in this manner, the top surface of the head comprises downwardly-slanted portions that collectively define upper perimeters of the first and second through holes, and the bottom surface of the head comprises upwardly-slanted portions that collectively define lower perimeters of the first and second through holes.

The upper perimeters of the first and second through holes are each configured to receive one or more weights to adjust a weight of the head of the golf club and if desired change a weight distribution of the golf club.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
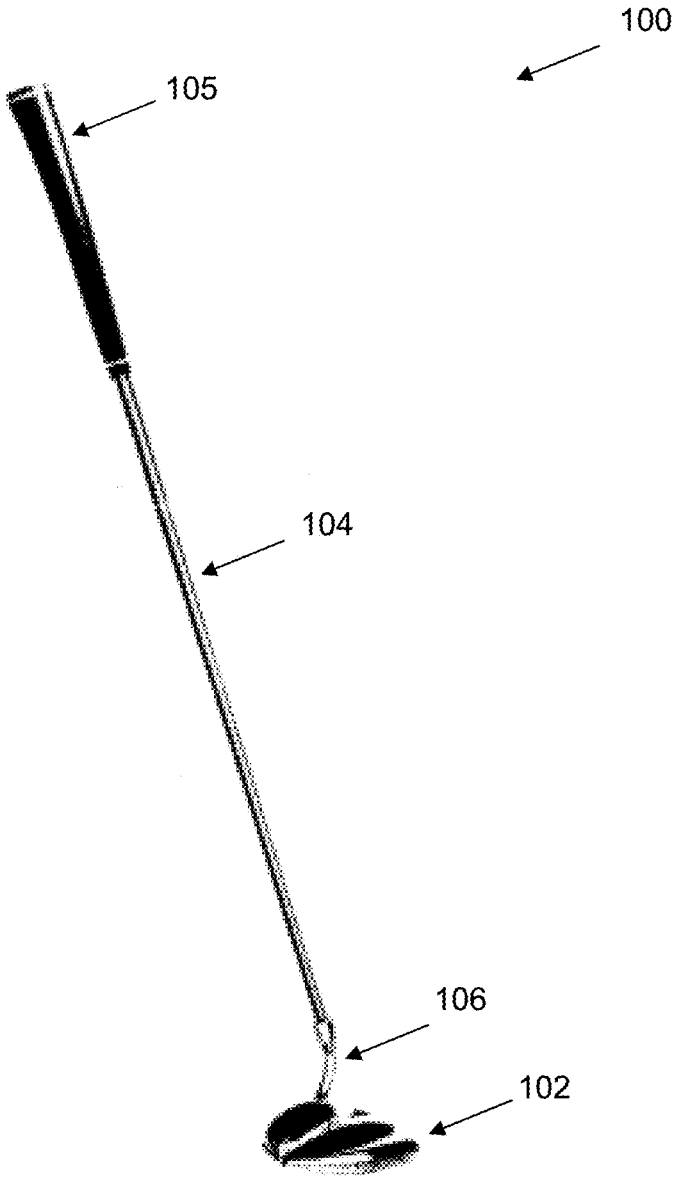
FIG. 1 illustrates one embodiment of a golf club.
Figure 2:
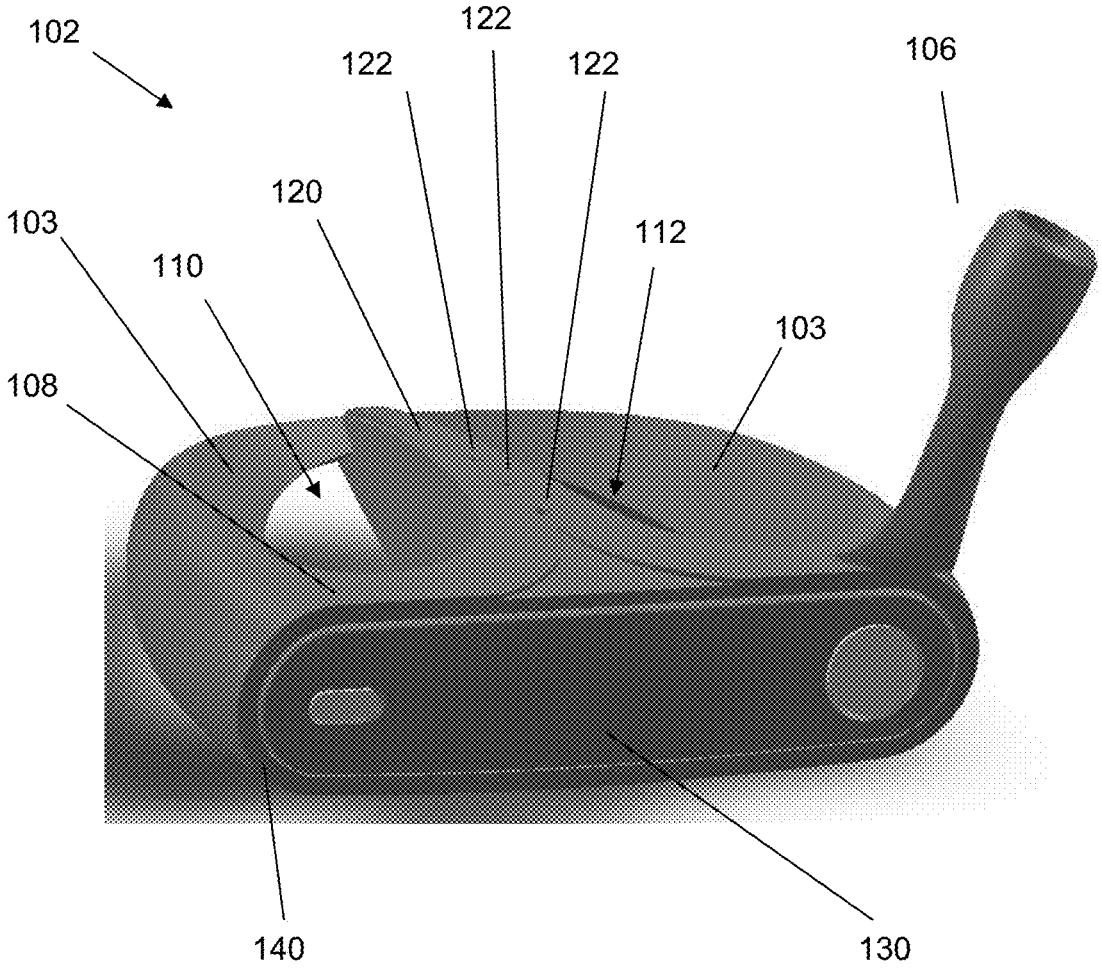
FIG. 2 illustrates a front, perspective view of the head of the golf club of FIG. 1.
Figure 3:
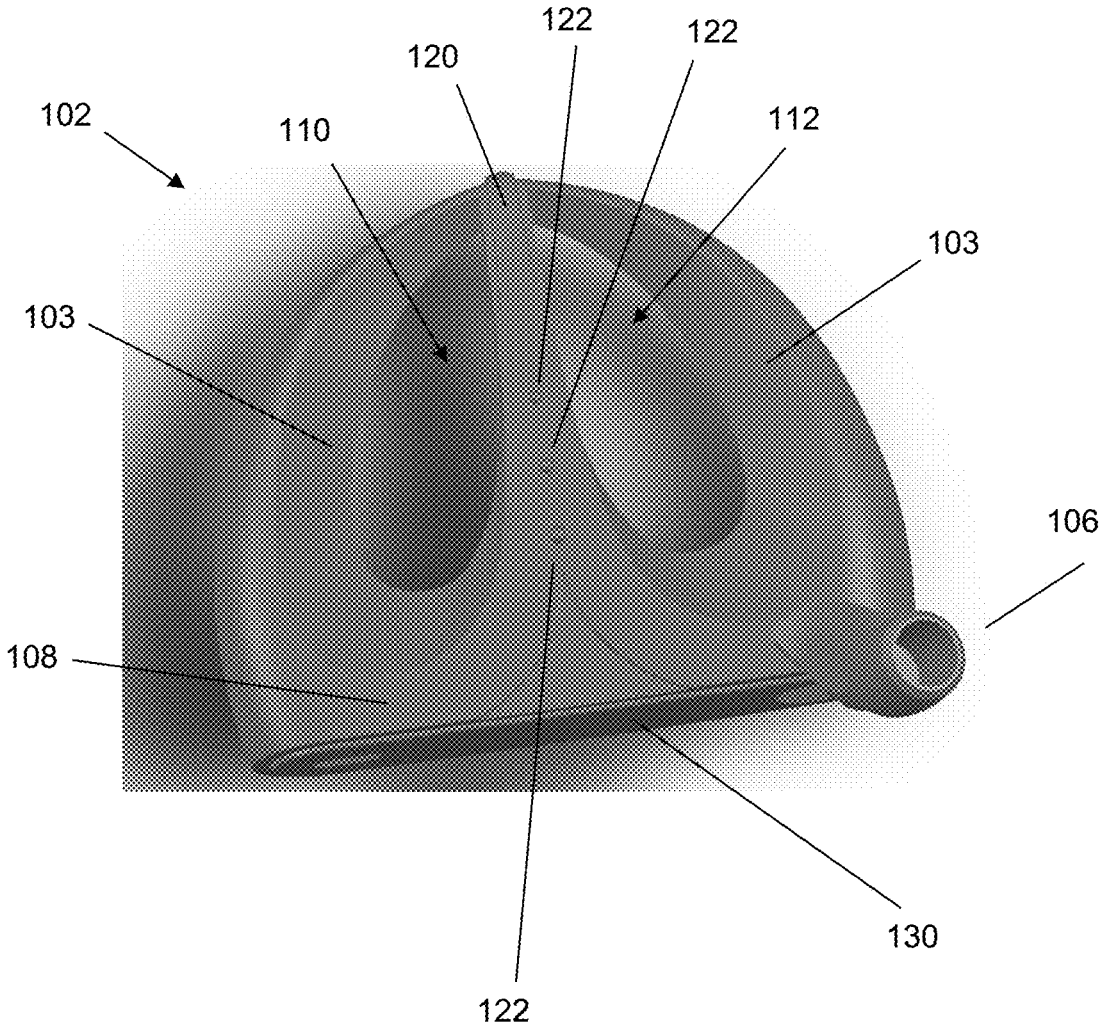
FIG. 3 illustrates a top view of the head of the golf club of FIG. 1.

FIG. 1 illustrates one embodiment of an adjustable golf club 100 comprising a head 102 and a shaft 104 with a grip 105 coupled to one another via a hosel 106. It is contemplated that portions of the head can be cast molded.

Various views of the head 102 of the golf club 100 are shown in FIGS. 2-17. As shown, the head 102 can include a top surface 108 and a bottom surface 109, with a first through hole 110 and a second through hole 112 that each extends through the head 102 from the top surface 108 to the bottom surface 109.

In preferred embodiments, the first and second through holes 110, 112 are separated from one another by a dividing wall 120 that forms a portion of a boundary or perimeter of each of the first and second through holes 110, 112. Preferably, the dividing wall 120 can increase in width, such that a portion of the dividing wall 120 closest to the front or face of the head 102 is wider than the portion of the dividing wall 120 closet to the back of the head 102.

As shown best in FIGS. 5-9, the interior of the head 102 including the dividing wall 120 preferably comprises a single piece that has a hollow interior. This advantageously reduces the overall weight of the head 102.

Figure 7:
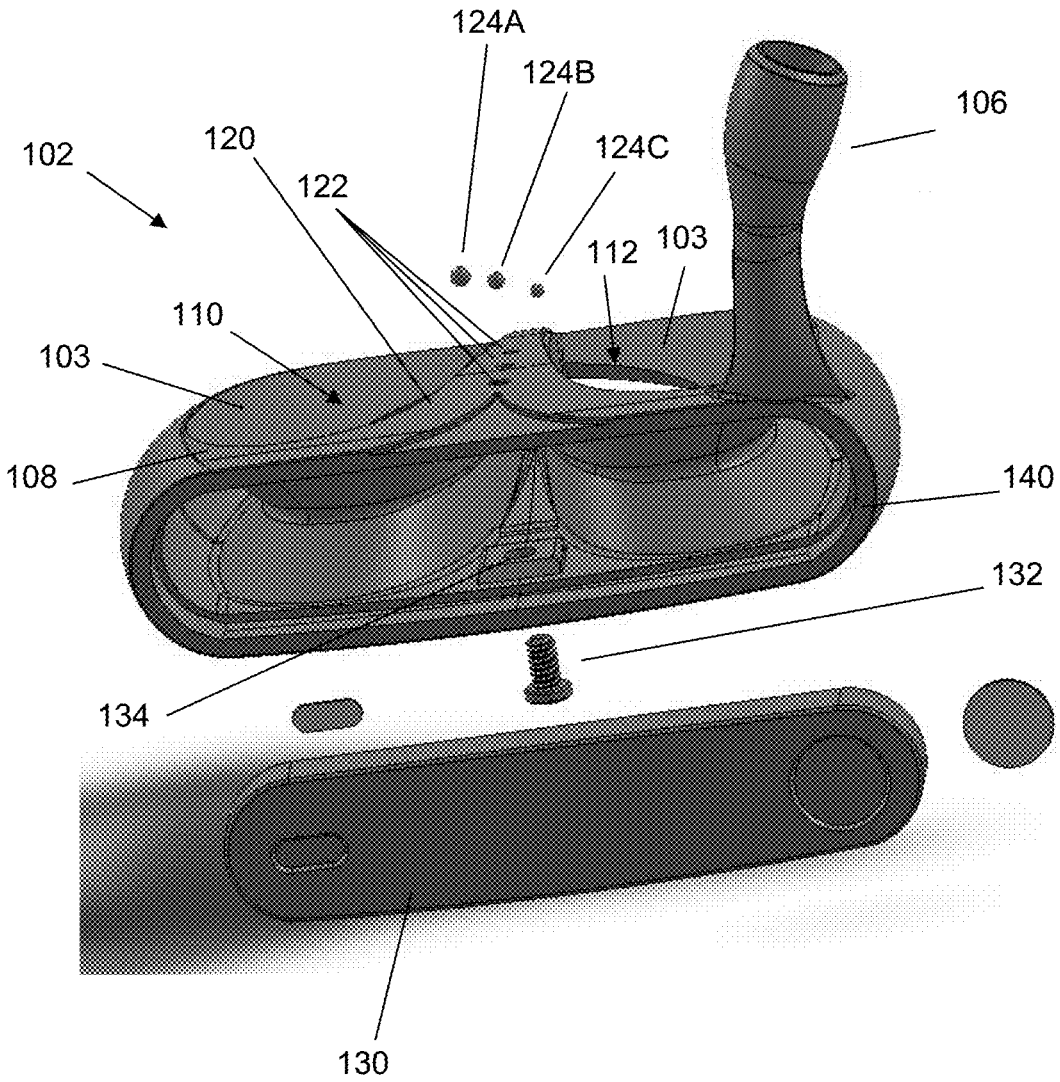
FIG. 7 illustrates an exploded view of the head of the golf club of FIG. 1 having a hollow interior.
Figure 8:
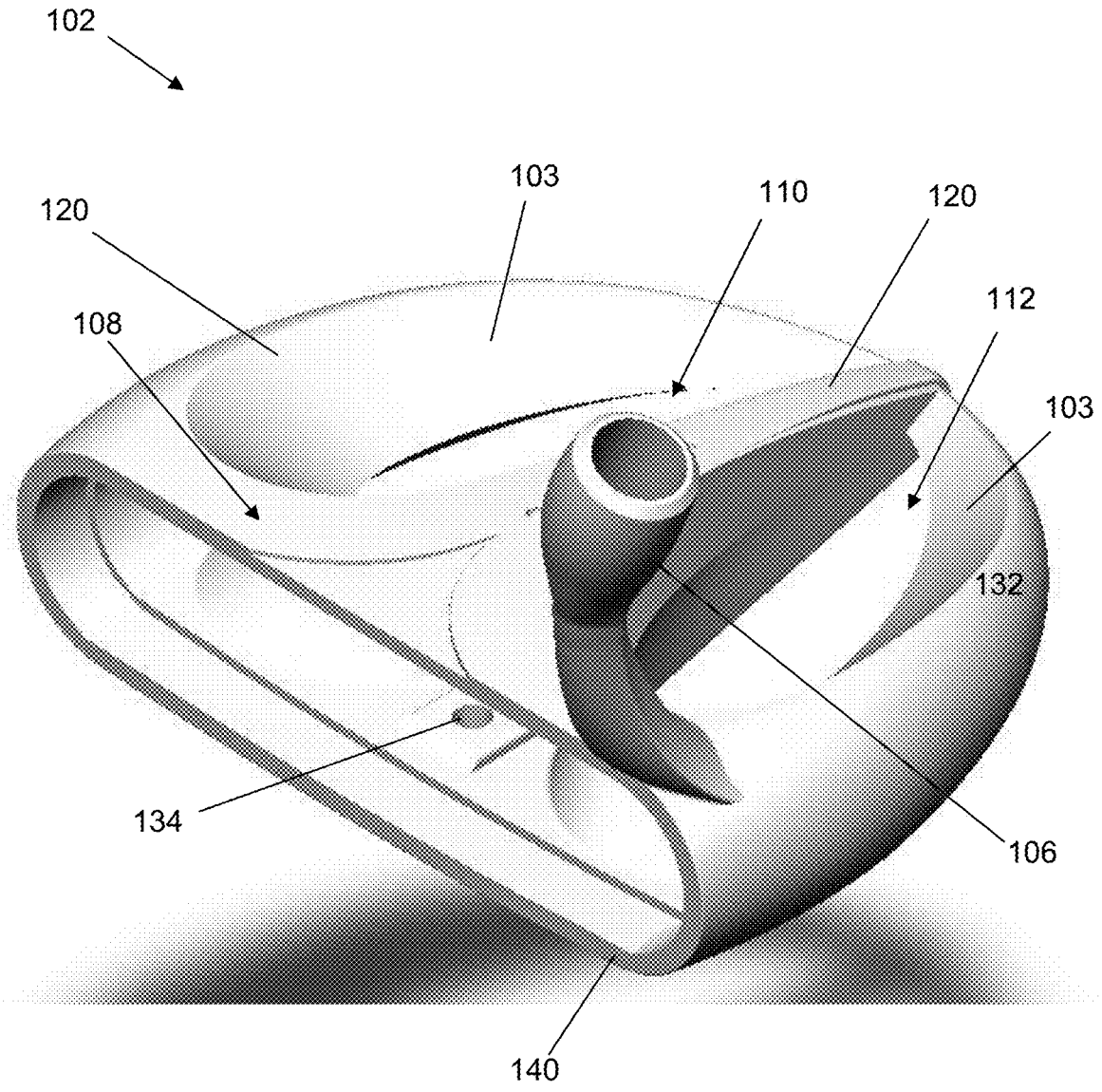
FIG. 8 illustrates an isometric view of the head of the golf club of FIG. 1 without the face weight removed and having a hollow interior.

In some contemplated embodiments, the top surface 108 of the head 102 on the dividing wall 120 can include one or more recesses or indentations 122. These one or more recesses or indentations 122 can be the same size and dimension, but are more preferably of different sizes and dimensions. Each of the one or more recesses or indentations 122 can be configured to receive a weight 124A, 124B, 124C that when added can vary a total weight of the golf club 100 as well as an overall weight distribution of the head 102. An example of the weights is shown in FIG. 7.

In preferred embodiments, the weights 124A, 124B, 124C can be spherical and configured to be inserted into one of the one or more recesses 122. It is contemplated that the weights can be held in place by their weight and/or via a magnet, a friction fit, or other commercially suitable fastener.

Figure 4:
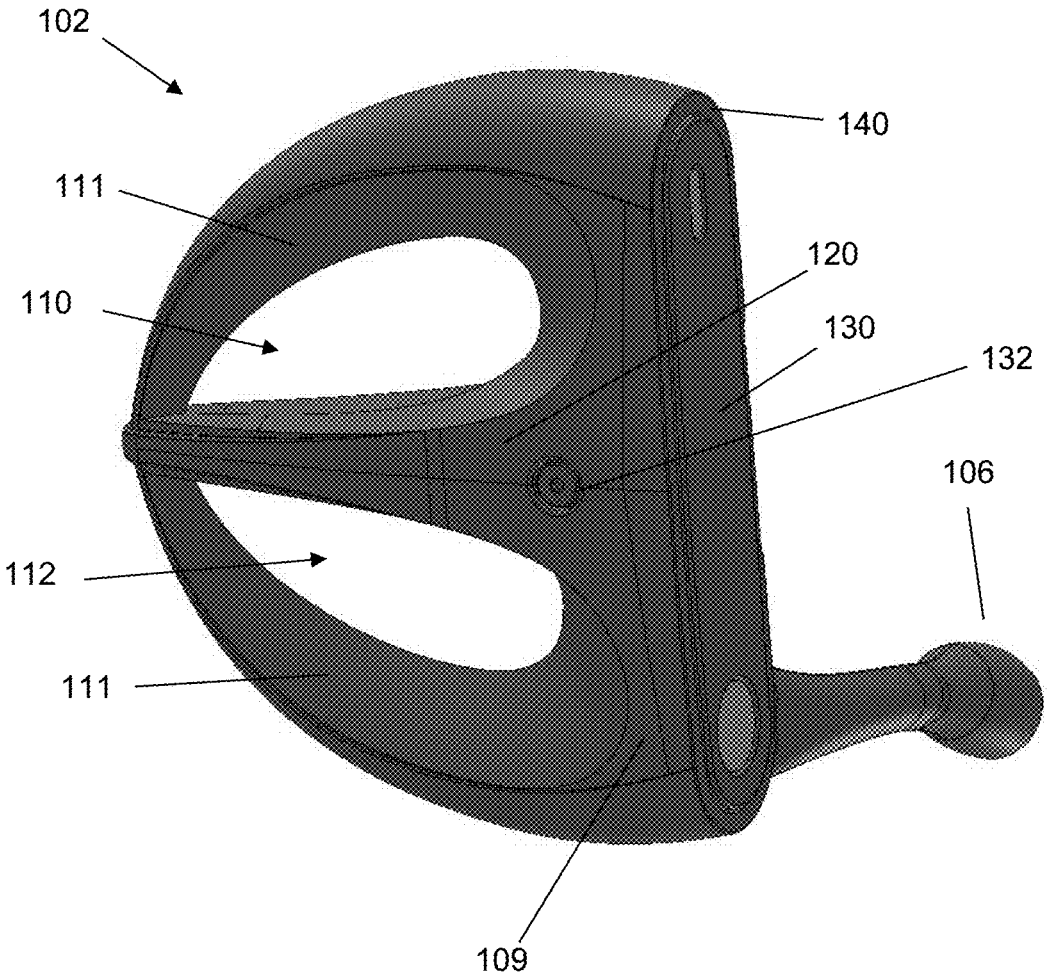
FIG. 4 illustrates a bottom view of the head of the golf club of FIG. 1.
Figure 5:
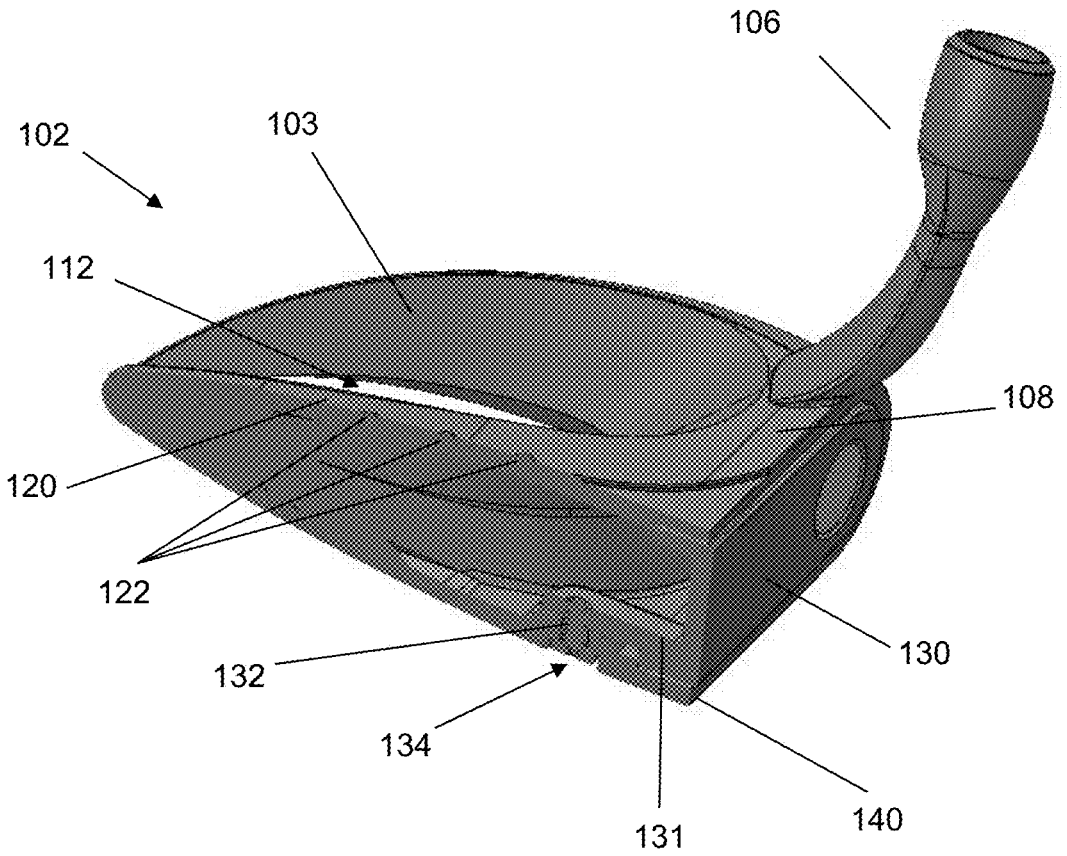
FIG. 5 illustrates a vertical, cross-section view of the head of the golf club of FIG. 1 having a hollow interior.
Figure 6:
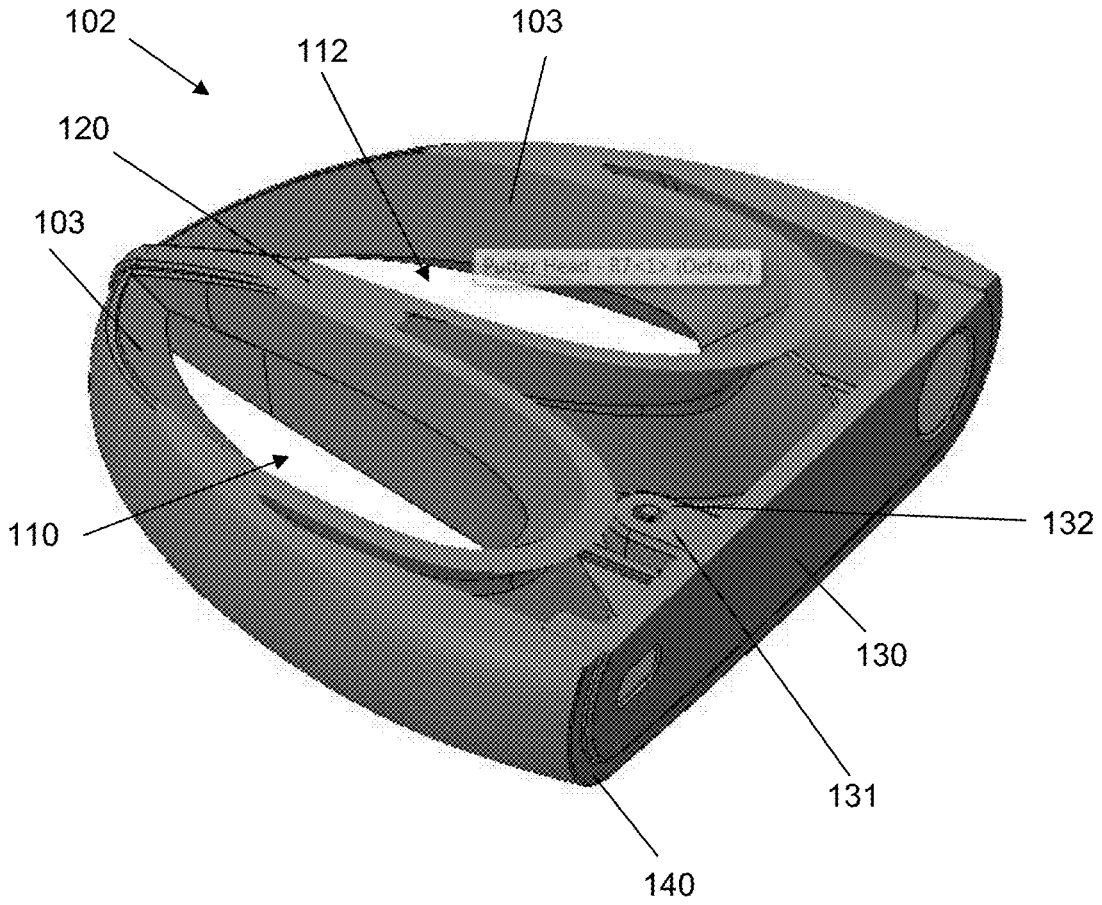
FIG. 6 illustrates a horizontal, cross-section view of the head of the golf club of FIG. 1 having a hollow interior.
Figure 15:
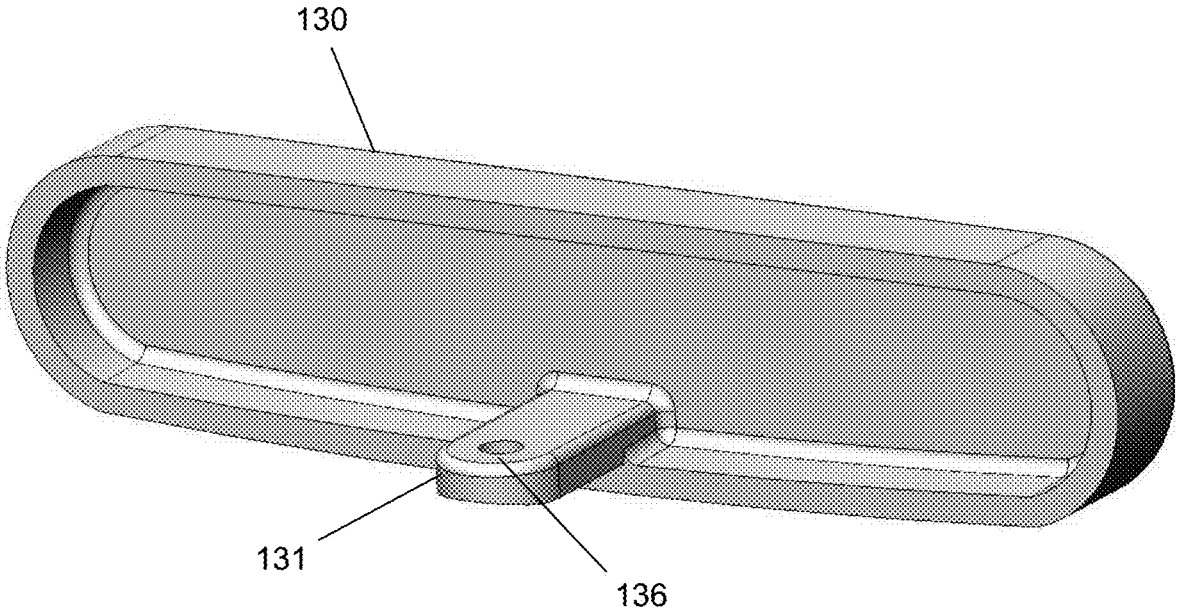
FIG. 15 illustrates a back, perspective view of one embodiment of the removable face weight of the golf club of FIG. 1.
Figure 16:
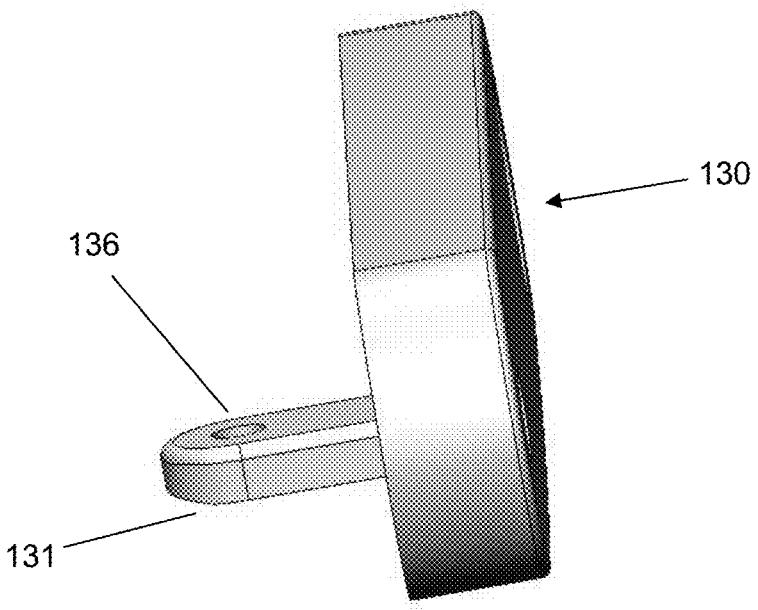
FIG. 16 illustrates a side view of the removable face weight of FIG. 15.
Figure 17:
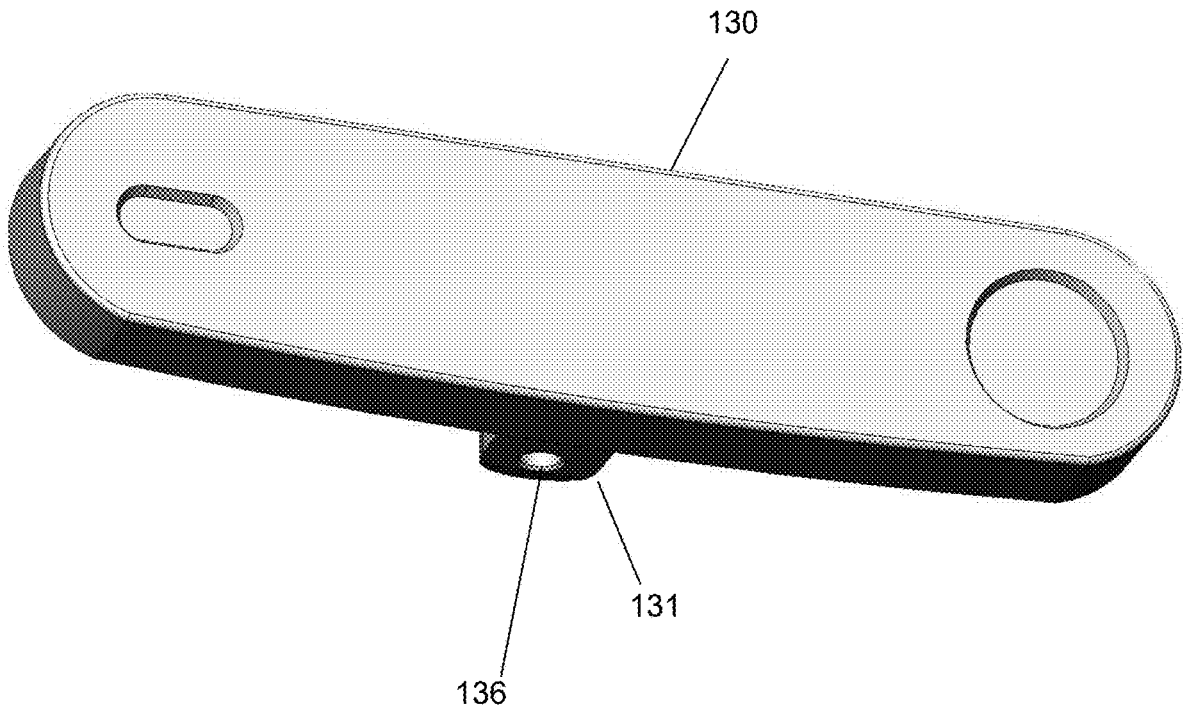
FIG. 17 illustrates a front, perspective view of the removable face weight of FIG. 15.

The head 102 preferably comprises a face weight 130 that is removably coupled to the head 102. Preferably, the face weight 130 is secured to the head via a fastener 132. Although a screw is shown, it is contemplated that any commercially suitable fattener(s) could be used including for example, a clip, a latch, a magnet, a snap, and so forth. As shown in FIGS. 4-5 and 7, the fastener 132 can be inserted into a hole 134 in the bottom surface 109 to thereby secure the face weight 130 to the head 102. The face weight 130 may comprise a solid front piece or face with a projection extending outwardly behind the front piece as shown in FIGS. 15-17. In some embodiments, the projection comprises an aperture through which the fastener 132 can be inserted to secure the face weight 130 to the head 102.

The head 102 can include a structure or frame configured to receive the face weight 130, such that when the face weight 130 is received within the structure or frame of the head 102, the front piece of the face weight 130 is flush with a face 140 (front exterior surface) of the head 102.

It is especially preferred that the face weight 130 has a weight that is at least 20% of the total weight of the head 102 when the face weight 130 is coupled to the head 102. In certain embodiments, it is contemplated that the face weight 130 has a weight that is more than 50% of the total weight of the head 102 when the face weight 130 is coupled to the head 102. In this manner, the use of different face weights can dramatically alter the overall weight of the head 102.

It is further contemplated that the face weight 130 may comprise different lofts ranging from 0.5 degrees to 3 degrees. In addition, different face weights may be removable coupled to the head 102 that comprise different core materials to thereby modify impact of the golf club with the golf ball.

In some contemplated embodiments, the top surface 108 of the head 102 has downwardly-slanted portions 103 that lead into each of the first and second through holes 110, 112. The downwardly-slanted portions 103 collectively define some or all of the upper perimeters of the first and second through holes 110, 112. In this manner, each of the first and second through holes 110, 112 can be defined by side walls that are inwardly tapered. The downwardly-slanted portions or walls 103 that define the through holes 110, 112 may be best shown in the cross-section view of FIG. 6. Some or all of the dividing wall 120 may be orthogonal (not slanted) relative to the top surface 108.

As shown, it is preferred the portions or walls 103 slant downwardly to a middle or center portion of the head 102, as measured between the top surface 108 and the bottom surface 109. From the middle or center portion to the bottom portion, it is preferred that the portions or walls of the bottom surface 109 are also slanted. In this configuration, the through holes 110, 112 will have a greatest diameter at the top surface 108 and the bottom surface 109, and a minimum diameter at the middle or center portion.

Figure 9:
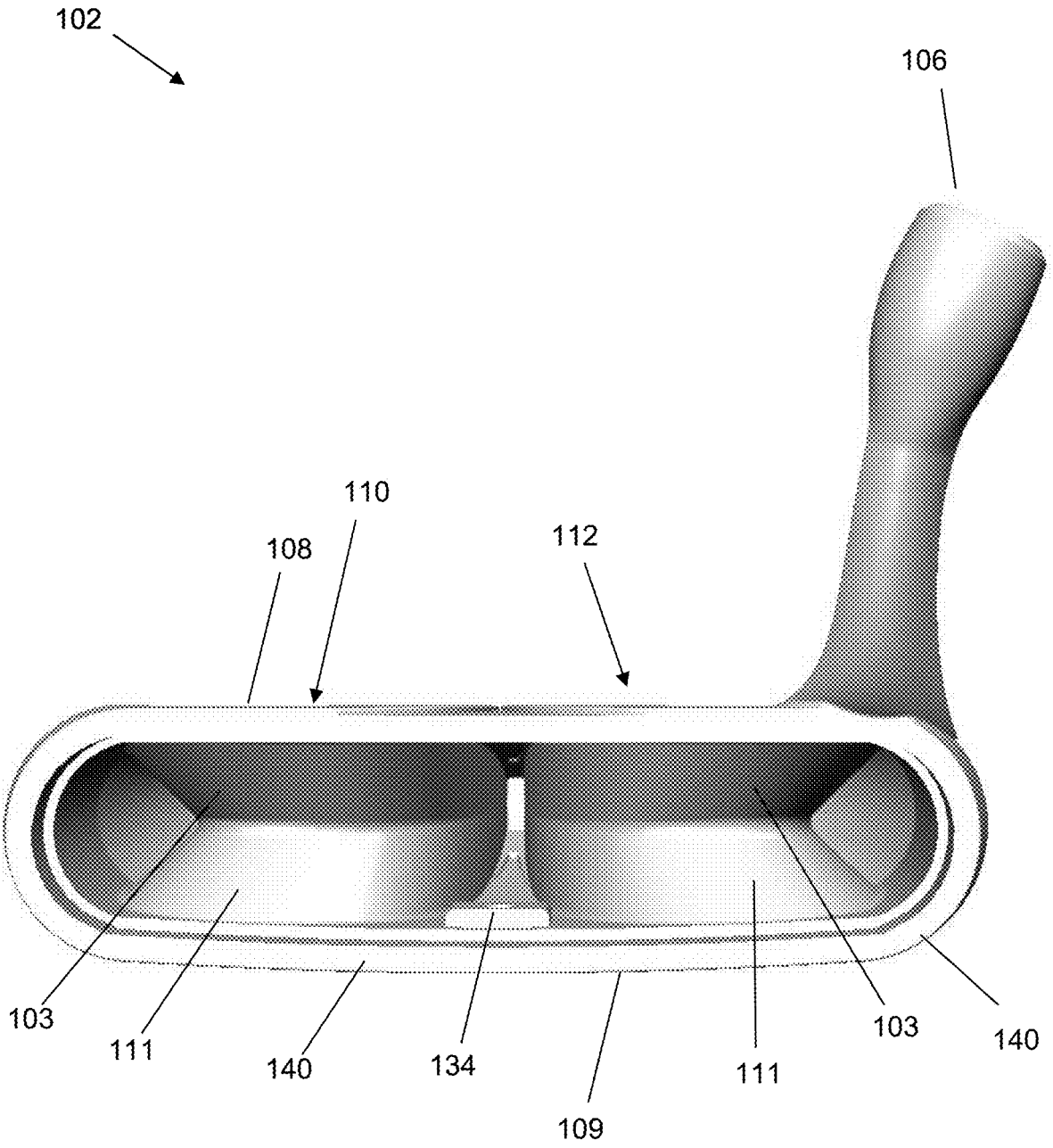
FIG. 9 illustrates a front view of the head of the golf club of FIG. 1 without the face weight removed and having a hollow interior.
Figure 10:
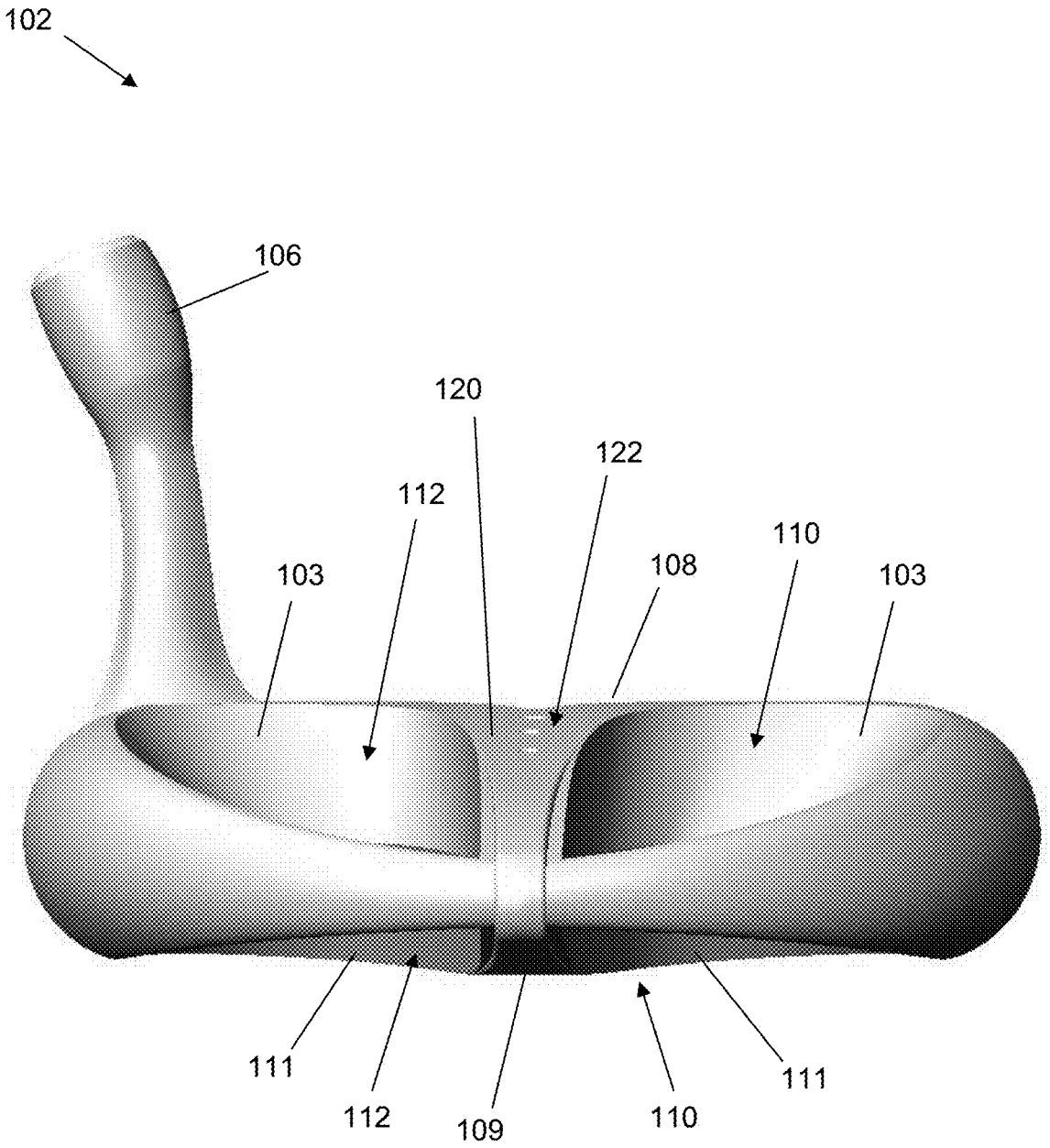
FIG. 10 illustrates a back view of the head of the golf club of FIG. 1 without the face weight removed.
Figure 11:
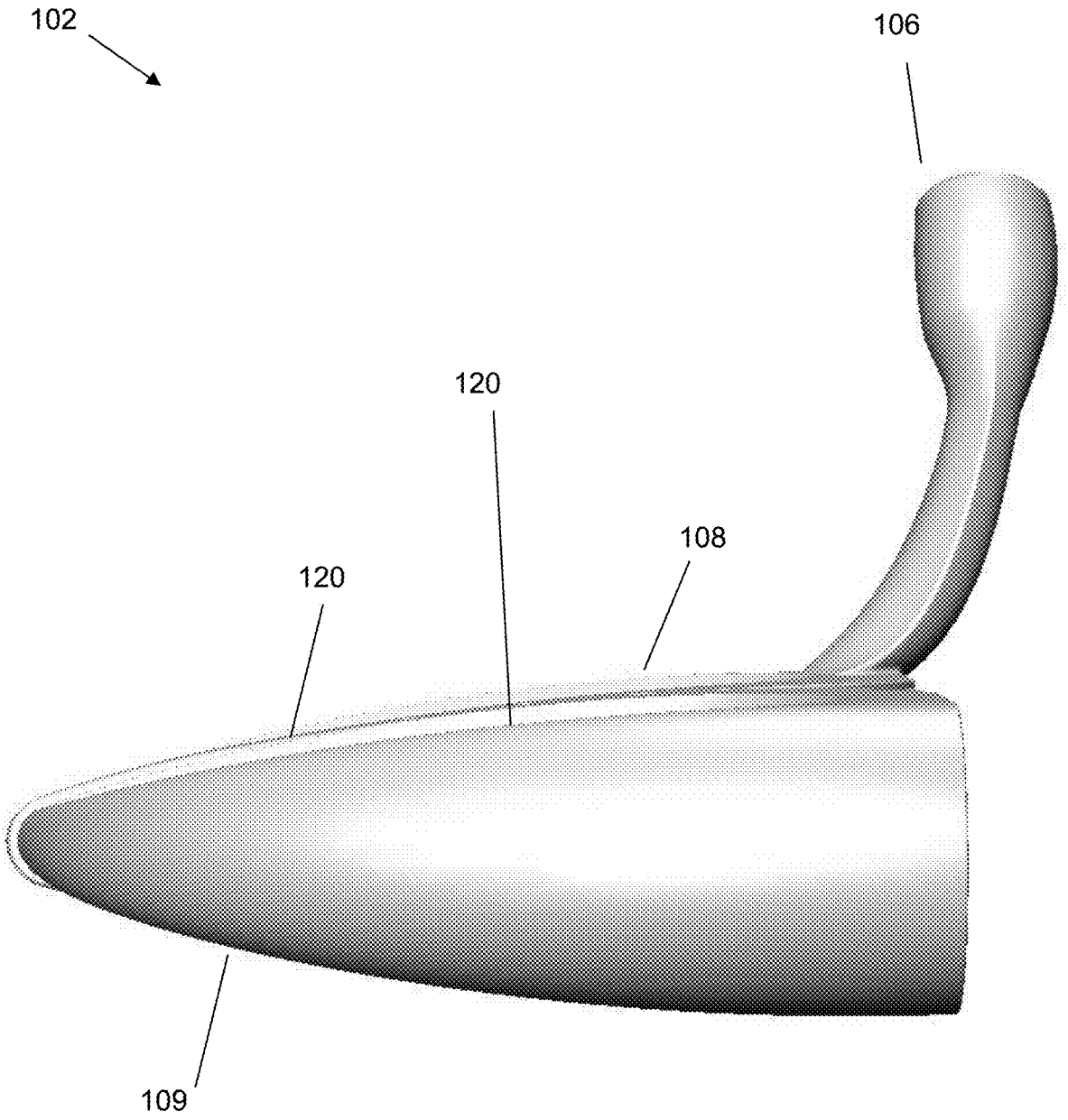
FIG. 11 illustrates a left-side view of the head of the golf club of FIG. 1 without the face weight removed.
Figure 12:
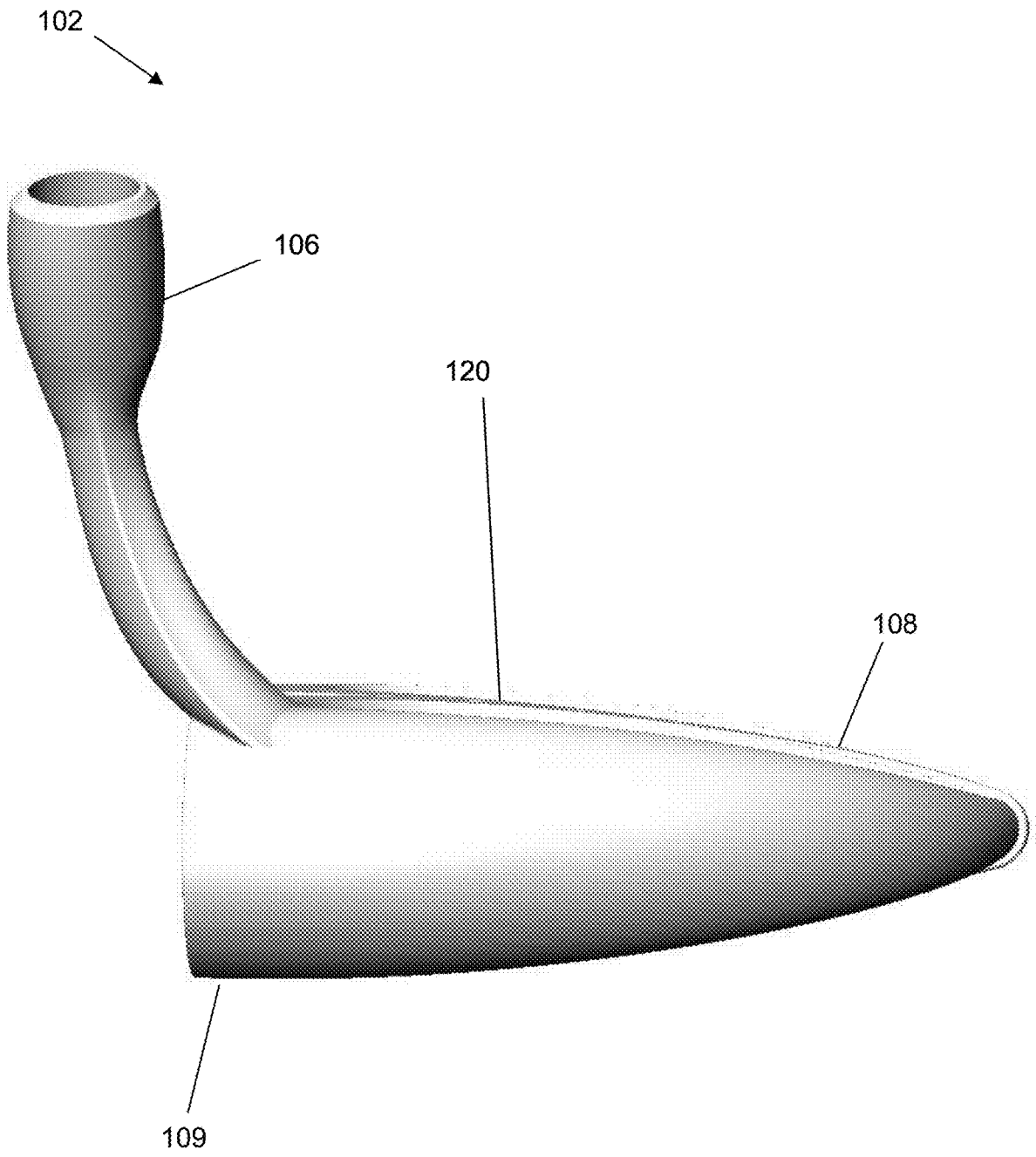
FIG. 12 illustrates a right-side view of the head of the golf club of FIG. 1 without the face weight removed.
Figure 13:
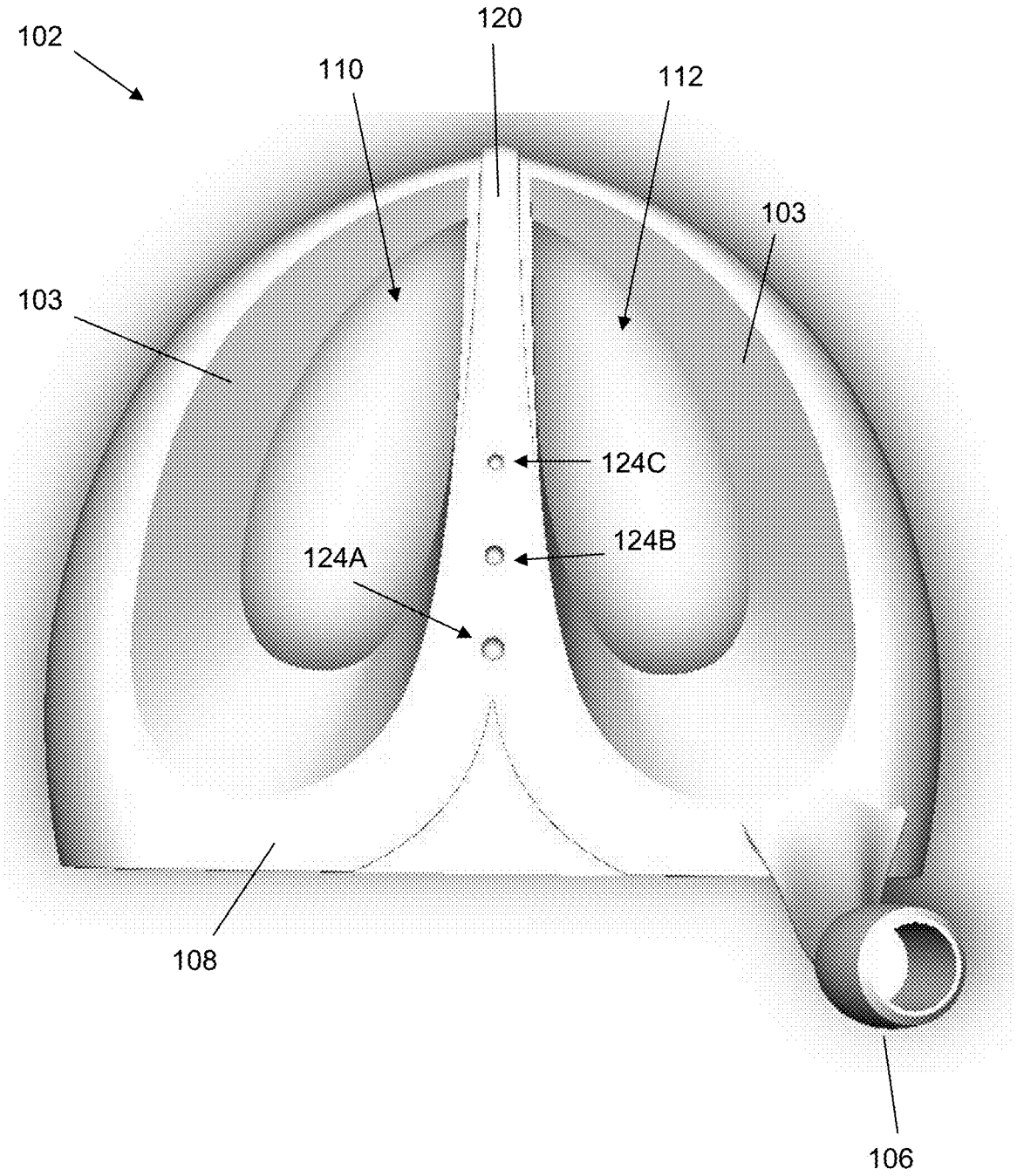
FIG. 13 illustrates a top view of the head of the golf club of FIG. 1 without the face weight removed.
Figure 14:
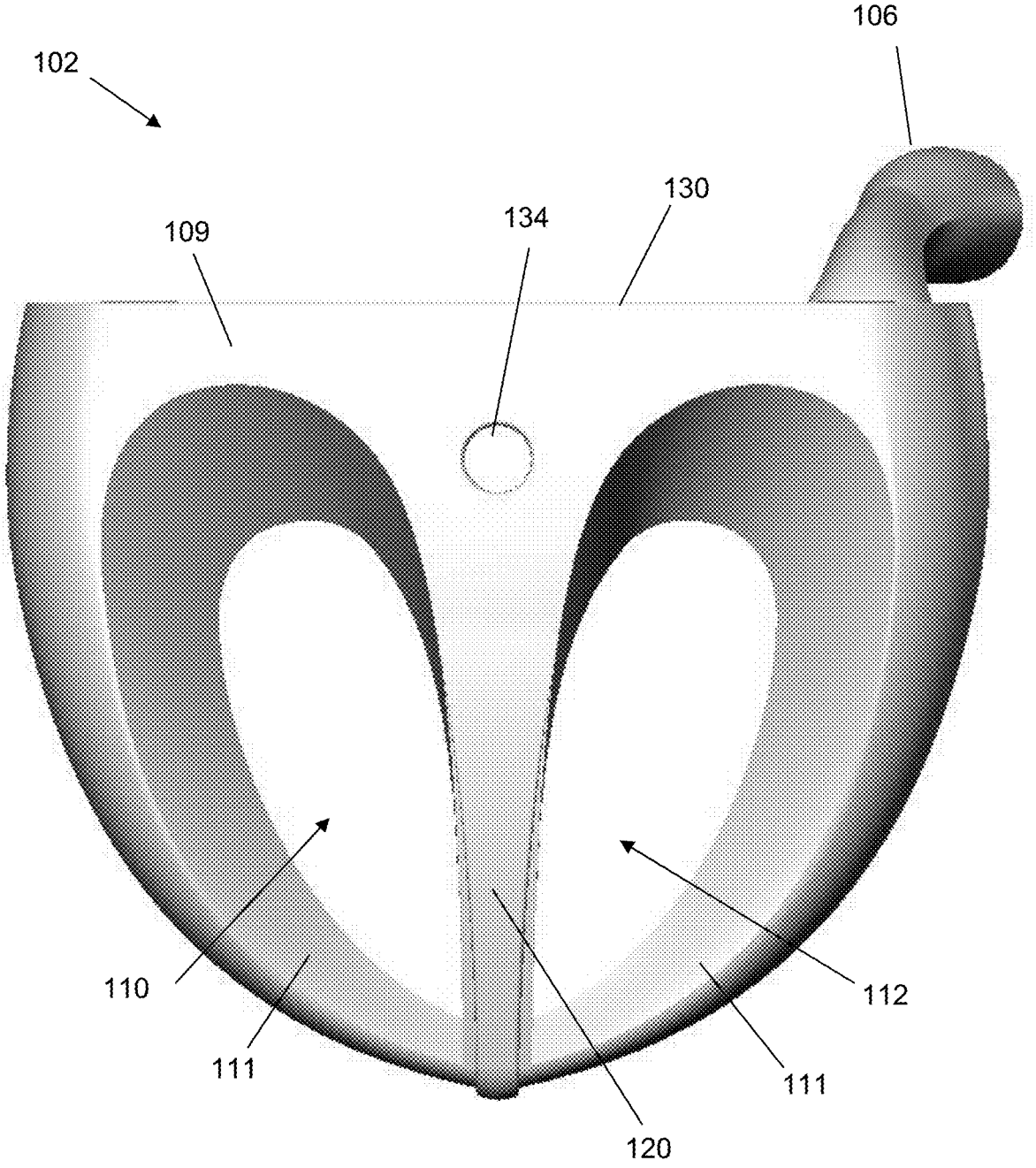
FIG. 14 illustrates a bottom view of the head of the golf club of FIG. 1 without the face weight removed.

As shown in FIG. 4, for example, the bottom surface 109 of the head 102 can include upwardly-slanted portions 111 that collectively define lower perimeters of the first and second through holes 110, 112. Thus, a portion of the wall defining each of the through holes 110, 112 is shown in FIG. 9, wherein the middle or center portion has the narrowest width or diameter and the upper or bottom portions of the through holes 110, 112 has the largest width or diameter.

Figure 18A:
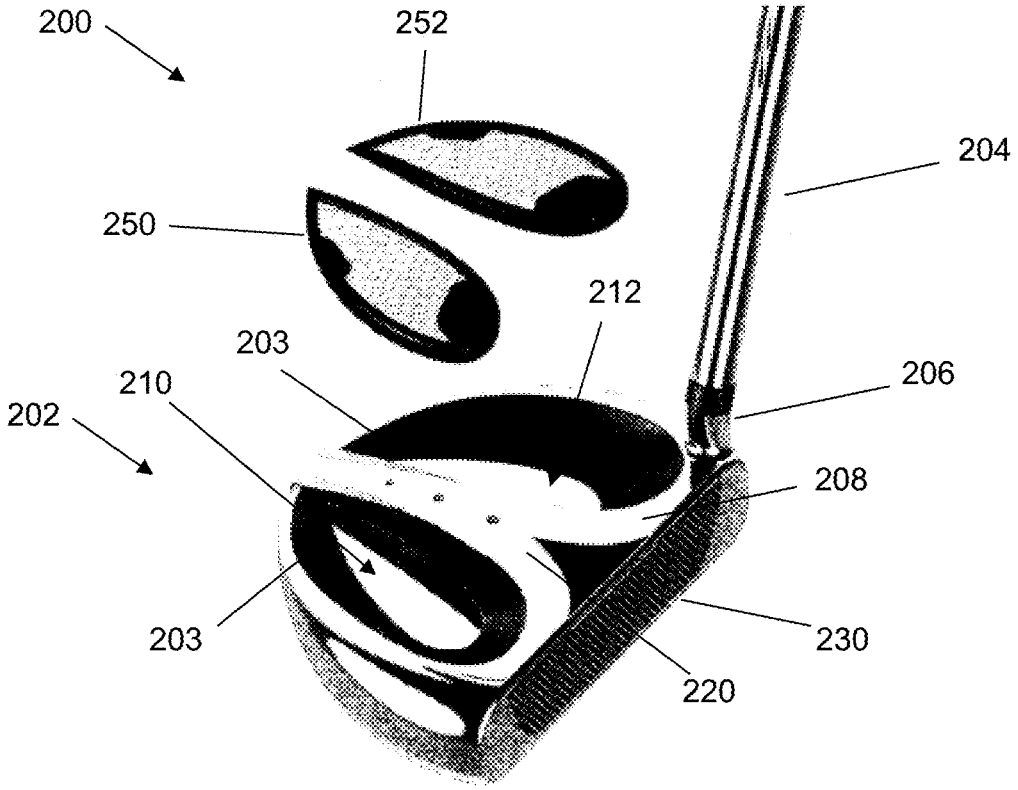
FIGS. 18A-18B illustrates perspective views of another embodiment of a golf club showing weights before and after coupling with the head, respectively.
Figure 18B:
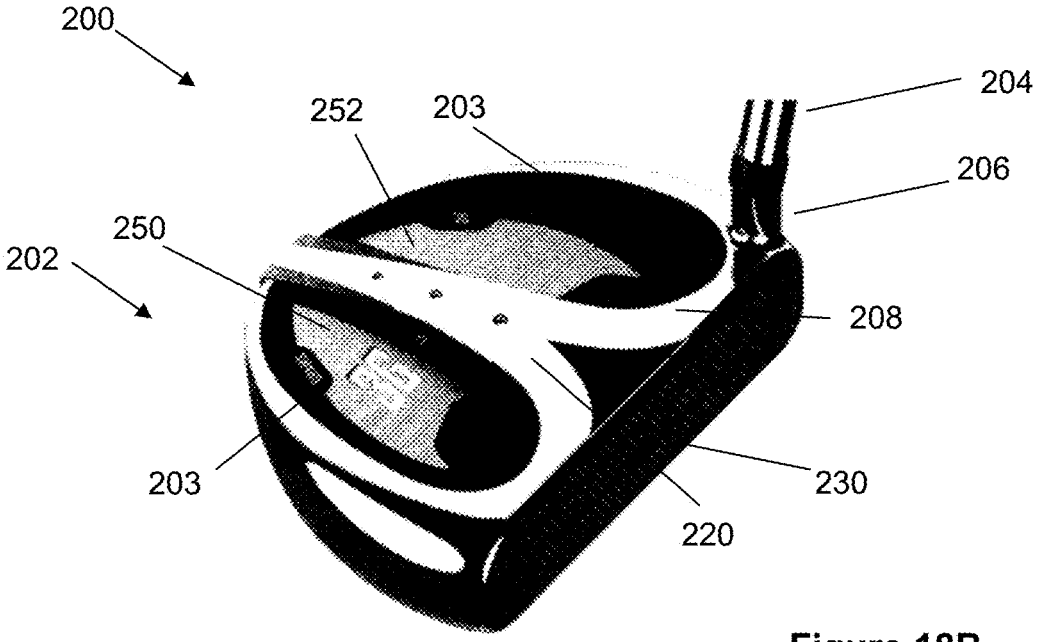
Figure 19:
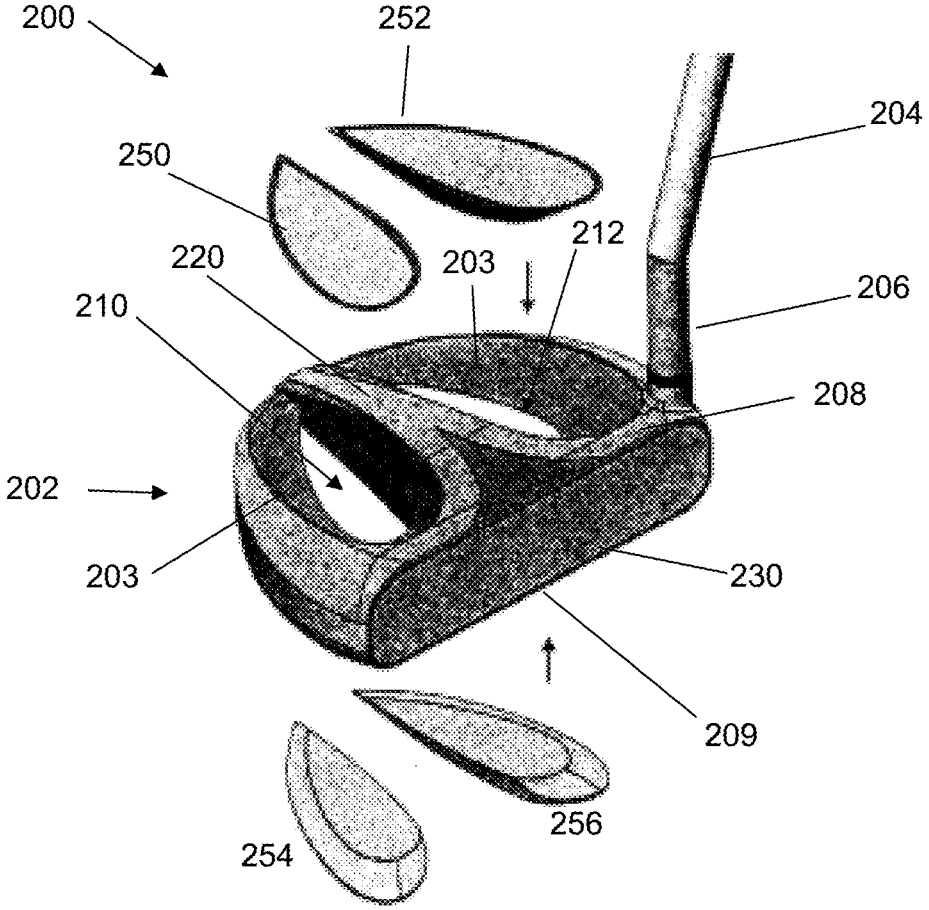
FIG. 19 illustrates a perspective view of the golf club of FIGS. 18A-18B with four weights.

As shown in FIGS. 18A-18B and 19, golf club 200 can include a head 202 similar to that described above with respect to FIGS. 1-17. The first and second through holes 210, 212 can each be configured to receive a weight 250, 252, respectively. The golf club 200 with the weights 250, 252 inserted into the through holes 210, 212 is shown in FIG. 18B. As shown, the weights can rest on the downwardly-slanted portions 203 of the top surface 208.

In this manner, a total weight and potentially a weight distribution of the head 202 of the golf club 200 can be adjusted by adding or removing weights 250, 252, as well as by changing the removable face weight 230. It is contemplated that a user could add different amounts of weight or multiple weights to each of the first and second through holes 210, 212 (e.g., stacking multiple weights one on top of the next) depending on user's preference.

It is contemplated that the weights 250, 252 could be held in place within the first and second through holes 210, 212 via the gravity and the downwardly-slanted portions 203. However, it is also contemplated that a fastener could be used including, for example, a magnet disposed on the head 204 or within each weight 250, 252, or other commercially suitable fastener. With respect to the remaining numerals in each of FIGS. 18A-18B, the same considerations for like components with like numerals of FIG. 2 apply As shown in FIG. 19, it is contemplated that the head 202 could have weights 254, 256 inserted into the first and second through holes 210, 212 via the bottom surface 209. In such configurations, four separate areas could be used for larger weights. As shown, it is preferred that a portion of each weight 250, 252, 254, 256 is tapered to align with the downwardly-slanted portion 203 or upwardly-slanted portion 211, depending where the weight will be placed. The weights 250, 252, 254, 256 are preferably held in place via a fastener, which could be a magnet or other commercially suitable fastener.

Figure 20:
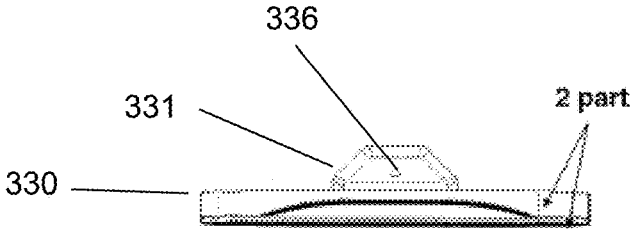
FIG. 20 illustrates a top view of another embodiment of a removable face weight for a golf club.

FIG. 20 illustrates another embodiment of a removable face weight 330, which includes a portion 331 that extends outwardly from a surface of the face weight 330, and preferably extends horizontally from a back surface of the face weight 330. The portion 331 can include a slot or hole 336 into which a fastener can be inserted to secure the face weight 330 to a head of a golf club.

As discussed above, it is contemplated that face weight 330 could be formed of two pieces, with the front-facing (outwardly facing) piece being composed of spring steel.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A golf club, comprising:

a head having first and second through holes that extend through top and bottom surfaces of the head, and a hosel extending from the head, wherein the head comprises an opening at a face of the head;

wherein the first and second through holes are separated from one another by a dividing wall that forms a portion of a boundary of each of the first and second through holes;

a face weight removably coupled to the head via a fastener that is inserted into the head and through a portion of the face weight to secure the face weight to the head, wherein the face weight is configured to be received within the opening at the face of the head such that the face weight is flush with a front exterior surface of the head;

wherein a weight of the face weight is at least 20% of the weight of the head without the face weight; and wherein the head is configured to be coupled with a shaft via the hosel.

2. The golf club of claim 1, wherein each of the first and second through holes is defined by side walls that are inwardly tapered.

3. The golf club of claim 2, wherein the top surface of the head comprises downwardly-slanted portions that collectively define upper perimeters of the first and second through holes.

4. The golf club of claim 3, wherein the bottom surface of the head comprises upwardly-slanted portions that collectively define lower perimeters of the first and second through holes.

5. The golf club of claim 4, wherein each of the first and second through holes has a diameter or width that decreases from the top surface to a minimum distance at a middle portion of the head as measured between the top and bottom surfaces, and increases from the middle portion to the bottom surface.

6. The golf club of claim 1, wherein the fastener extends into an aperture in the bottom surface of the head to secure the face weight to the head.

7. The golf club of claim 1, wherein the face weight comprises first and second pieces attached to one another, and wherein the first piece is outwardly facing when the face weight is coupled to the head, and wherein the first piece is composed of spring steel.

8. The golf club of claim 1, wherein the top surface of the head further comprises at least one recess or indentation.

9. The golf club of claim 8, further comprising a spherical weight configured to be inserted or rest within the at least one recess or indentation.

10. The golf club of claim 1, further comprising first and second weights, wherein each of the first and second weights is placed on top of the head such that the first weight at least partially covers the first through hole and the second weight at least partially covers the second through hole.

11. The golf club of claim 10, wherein the first weight is configured to rest on the downwardly-slanted portions of the top surface of the head that defines the first through hole and the second weight is configured to rest on the downwardly-slanted portions of the top surface of the head that defines the second through hole.

12. The golf club of claim 11, wherein the first weight is coupled to the head by a magnet.

13. The golf club of claim 11, wherein the first weight is coupled to the head by gravity.

14. The golf club of claim 1, wherein the weight of the face weight is at least 50% of the weight of the head without the face weight.

* * * * *